US005425631A

United States Patent [19]

Krueger et al.

[11] Patent Number: 5,425,631

[45] Date of Patent: Jun. 20, 1995

[54] CONTROLLING A GASEOUS FUEL BURNER AND CONTROL VALVE THEREFOR

[75] Inventors: Donald M. Krueger, Westchester; Donald W. Cox, South Elgin; Joseph J. Cacciatore, Woodrige; James M. Pick, Elk Grove Village, all of Ill.

[73] Assignee: Eaton Corporation, Cleveland, Ohio

[21] Appl. No.: 289,482

[22] Filed: Aug. 11, 1994

[51] Int. Cl.[6] ..... F23N 5/20

[52] U.S. Cl. ..... 431/6; 431/71; 431/72; 236/15 A

[58] Field of Search ..... 236/15 A; 431/71, 72, 431/6

[56] References Cited

U.S. PATENT DOCUMENTS

| | | | |
|---|---|---|---|
| 2,501,850 | 3/1950 | Kunzler | 431/72 |
| 3,963,410 | 6/1976 | Baysinger | 236/15 A |
| 4,823,838 | 4/1989 | Ferlin | 137/624.12 |

*Primary Examiner*—Carroll B. Dority

*Attorney, Agent, or Firm*—Roger A. Johnston

[57] ABSTRACT

An electrically operated line valve has its outlet connected to the inlet of the manifold for supplying the user actuated individual gas burner valves and a user actuated line power switch is closed before opening of any of the burner valves. A valve position detector signals an electronic controller which supplies power to the line switch only if a burner valve has been opened after closing of the line switch. A user actuatable manual override cable enables the line valve to be manually opened during periods of electrical power outage.

30 Claims, 9 Drawing Sheets

CONTROLLING A GASEOUS FUEL BURNER AND CONTROL VALVE THEREFOR

BACKGROUND OF THE INVENTION

The present invention relates to the operation of cooking appliances having surface burners and particularly such cooking appliances intended for household use as for example in a free standing range or a counter top burner arrangement. Gas ranges, as such appliances are often called, typically have in recent times electrical spark ignitors for the individual burners and employ a manifold connected to the gas supply line with individual user operated manual valves for controlling gas flow to the selected burners. In the design and manufacture of such household gas ranges it is common to have the manifold situated so as to position the control knobs for operating the burner valves on a control console on the front of the range in order that the user need not reach across the burners to operate the controls.

The individual burner valves for household gas ranges commonly have a cam operated switch which closes, upon movement of the valve control to a position for opening the valve, to energize the spark ignitor circuitry. Gas range burner controls of the aforesaid type have been in service for many years and have proven generally reliable and low in manufacturing cost which is an important consideration in mass produced household appliances sold into a highly competitive marketplace.

The aforesaid known gas rangetop burner control arrangements typically have the user actuated control knob for the selected individual burner valve moved to an initial open position in which the cam on the valve shaft closes the switch to energize the spark ignitor; and, subsequently the user moves the control knob to a different position to provide the required gas flow to produce the desired level of flame at the burner and the spark ignitor switch is thereupon opened and the ignitor operation ceases. In the event that the flame is extinguished with the burner valve in the open position, gaseous fuel continues to flow through the burner until such time as the user turns the valve to the closed or "OFF" position. Thus, it has been desired to provide an automatic system for shutting off gas flow to the range in the event of a flame-out condition with the aforesaid type of burner valve-ignitor arrangement.

It is also known in household gas ranges to provide a burner control arrangement for the top burners having a flame sensor with a normally closed switch electrically in series with the ignitor switch on the gas valve. In this latter type system, user manual movement of the burner control valve to any "ON" position causes the cam to keep the ignitor switch closed. The closure of cam operated switch in conjunction with the normally closed flame sensor switch causes the ignitor to continue to operate until the flame opens the flame sensor switch cutting off power to the ignitor. This arrangement has the advantage that in the event of a flame-out the flame sensor switch recloses and activates the ignitor to reignite the gas which continues emanating from the burner; however, the flame sensor adds significantly to the cost of the system.

It has been desired to provide an electrically operated line valve for shutting off gas to the rangetop burner manifold and to the oven burners such that the user can disable the range, such as for prolonged absences or where children will be present and there is a likelihood that the burner valve controls may be tampered with by the children. However, an electrically operated line valve for the purpose of rendering the range inoperative must accommodate the situation where power outages may occur to the household power supply during periods of normal range burner operation and upon restoration of power, prevent a condition where the burner valve would be open and gas caused to flow without re-ignition. Provision must also be made for burner operations during periods when the power is out. Thus, it has been desired to provide a way or means of electrically controlling and disabling a household gas range and in a manner which prevents any undue hazards.

SUMMARY OF THE INVENTION

It is an object of the present invention to provide a control system for a gaseous fuel burner having an electrically operated line valve controlling gas flow to a burner manifold and to provide automatic operation of the electric line valve in a manner which (a) prevents gas flow to a burner after a power outage and restoration of power and (b) does not permit gas to continue to flow to a burner after a flame outage.

It is another object of the invention to provide a gas burner control system having an electrically operated line valve that disables gas flow to the burner valve manifold unless the user has sequentially moved a burner valve control from an "OFF" position to an "ON" position to select operation of one of the burners.

The gas burner control system of the present invention employs an electrically operated line valve fluidically in series with the burner manifold inlet to control all gas flow to the manifold. The electric line valve is openable only in the event that the range user has moved one of the individual burner control valves to an "ON" position from a "CLOSED" position and an ignitor switch has first been closed by movement of the burner valve control. An optional user actuated manual override is provided to permit manual opening of the electric line valve in the event range operation is desired during a period of prolonged electrical power outage.

The electric line valve of the present invention is controlled by an all-electronic controller which is programmed to require first the closing of an ignitor switch provided on each of the burner control valves sequentially followed by receiving a second electrical signal from a valve position detecting switch provided on the control valve. In the preferred practice, the position detecting switch and ignitor switch are cam operated by rotation of the burner valve operating knob shaft.

DETAILED DESCRIPTION

Figure 1:
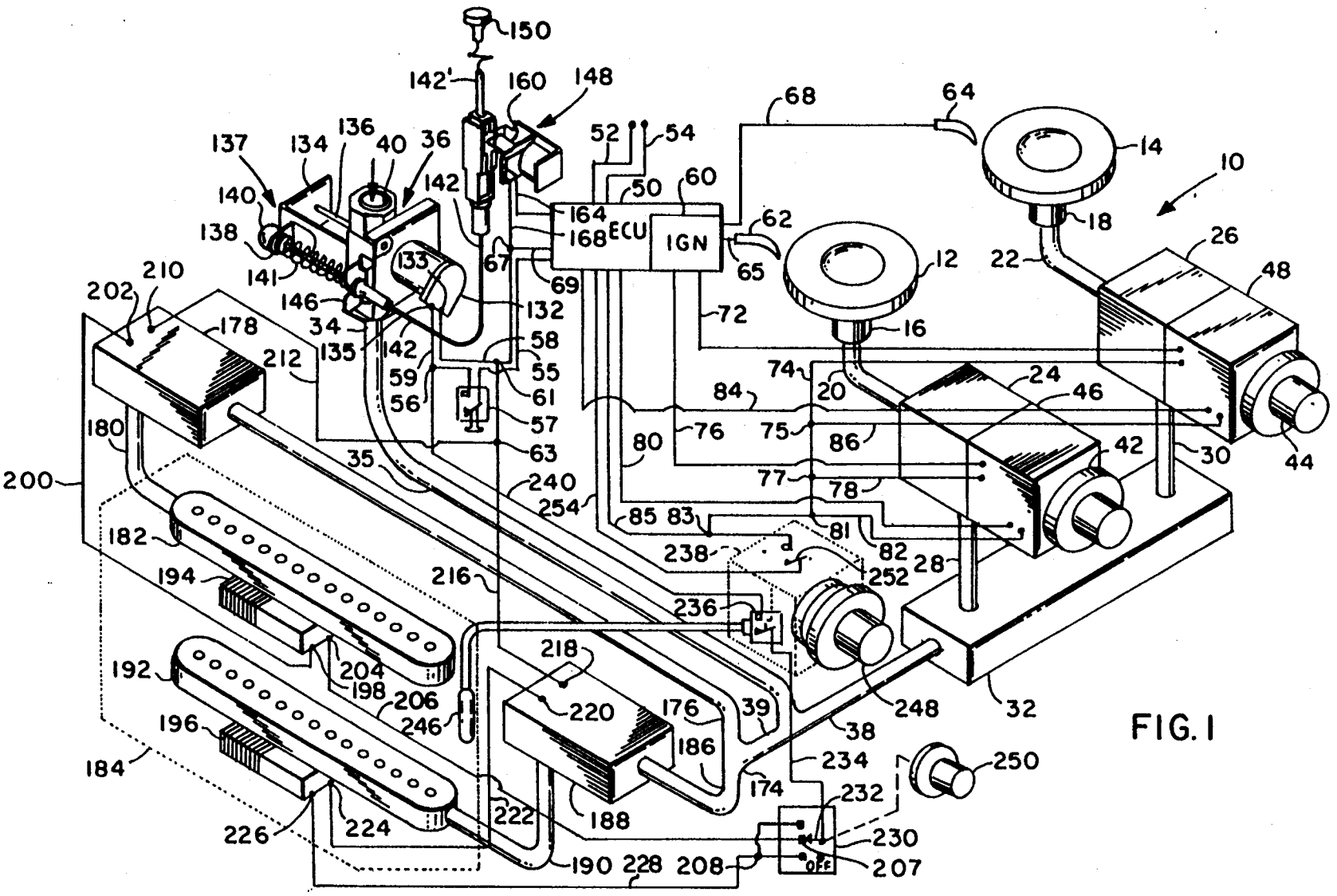
FIG. 1 is a schematic of a gaseous fuel burner control system for rangetop burners in accordance with the present invention.

Referring to FIG. 1, a burner control system employing the present invention is indicated generally at 10 and has a plurality of gas burner rings 12, 14 such as those of the type employed for the top burners in a household cooking range. Each of the burners has respectively an inlet aspirator tube denoted 16, 18 into which is inserted a gas supply tube 20, 22 respectively, with the supply tubes 20, 22 each connected to respectively the outlet of a burner selector valve denoted respectively 24, 26. Valves 24, 26 each have their inlets connected to a manifold outlet respectively 28, 30 of the gas supply manifold 32.

Manifold 32 has its inlet connected to one outlet 38 of a tee which has its inlet 37 connected to the outlet 34 of an electrically operated line valve indicated generally at 36 by conduit 35 which is indicated in dashed line in FIG. 1. The opposite outlet 39 of the tee is connected, as will be hereinafter described, to the inlet of an oven burner manifold. The inlet 40 of line valve 36 is connected to a fuel gas supply such as a natural gas line or bottled gas.

Each of the individual burner valves 24, 26 is operated manually by user rotation of a selector knob denoted respectively 42, 44. Each of the burner valves 24, 26 has attached thereto a cam operated switch assembly denoted respectively 46, 48 which will be described hereinafter in greater detail.

An electronic control unit (ECU) 50 which receives power from lines 52, 54 provides an output control signal to the electric actuator for line valve 36.

The controller 50 is connected by lead 58 to the electric valve 36 and by lead 55 to one side of a switch 57 which has the opposite side thereof connected through junction 56 and lead 59 for completing the circuit to the electric valve actuator. Switch 57 is a user operated switch remotely located to permit the user to disable the line valve 36 separately from the functions of the controller 50. The switch 57 may be employed where desired, as, for example, to provide redundancy of maintaining the line valve closed for example where there is a risk of small children tampering with the appliance. The opposite side of the electric actuator for valve 36 is connected along lead 58 to junction 61 which is also connected to junction 63 and to junction 67. Junction 67 is connected along lead 69 to the ECU.

Electronic control unit 50 may include high voltage circuitry 60 for operating spark ignitors 62, 64 which are disposed adjacent respectively each of the burners, with ignitor 62 connected to the circuitry 60 by lead 65; and, ignitor 64 connected to the ignitor circuitry 60 by lead 68. The ignitor circuitry 60, which may be of a type well known in the art, receives input signals from one of the switches in each of the switch assemblies 46, 48; and, switch connector lead 72 provides an input from the ignitor switch in switch assembly 48, whereas lead 76 provides an input to the ignitor circuitry 60 from the ignitor switch located in cam operated switch assembly 46. Although the ignitor circuitry is shown as combined with the ECU, the circuitry 60 may be disposed separately. The opposite side of the ignitor switch in assembly 98 is connected through lead 74 to junction 75; and, the opposite side of the ignitor switch in assembly 46 is connected through lead 78 to junction 77 which is connected to junction 75.

Switch assembly 46 also has a separate valve position detecting switch which has one side connected along lead 80 to the logic control circuitry of the control unit 50 and the other side connected along lead 82 to junction 81 which is also connected to junction 77 and junction 83, which is connected along lead 85 to the ECU. A valve position detecting switch in switch assembly 48 has one side connected to the controller 50 along lead 84 with the opposite side connected along lead 86 to junction 75.

Figures 2, 16, 17:
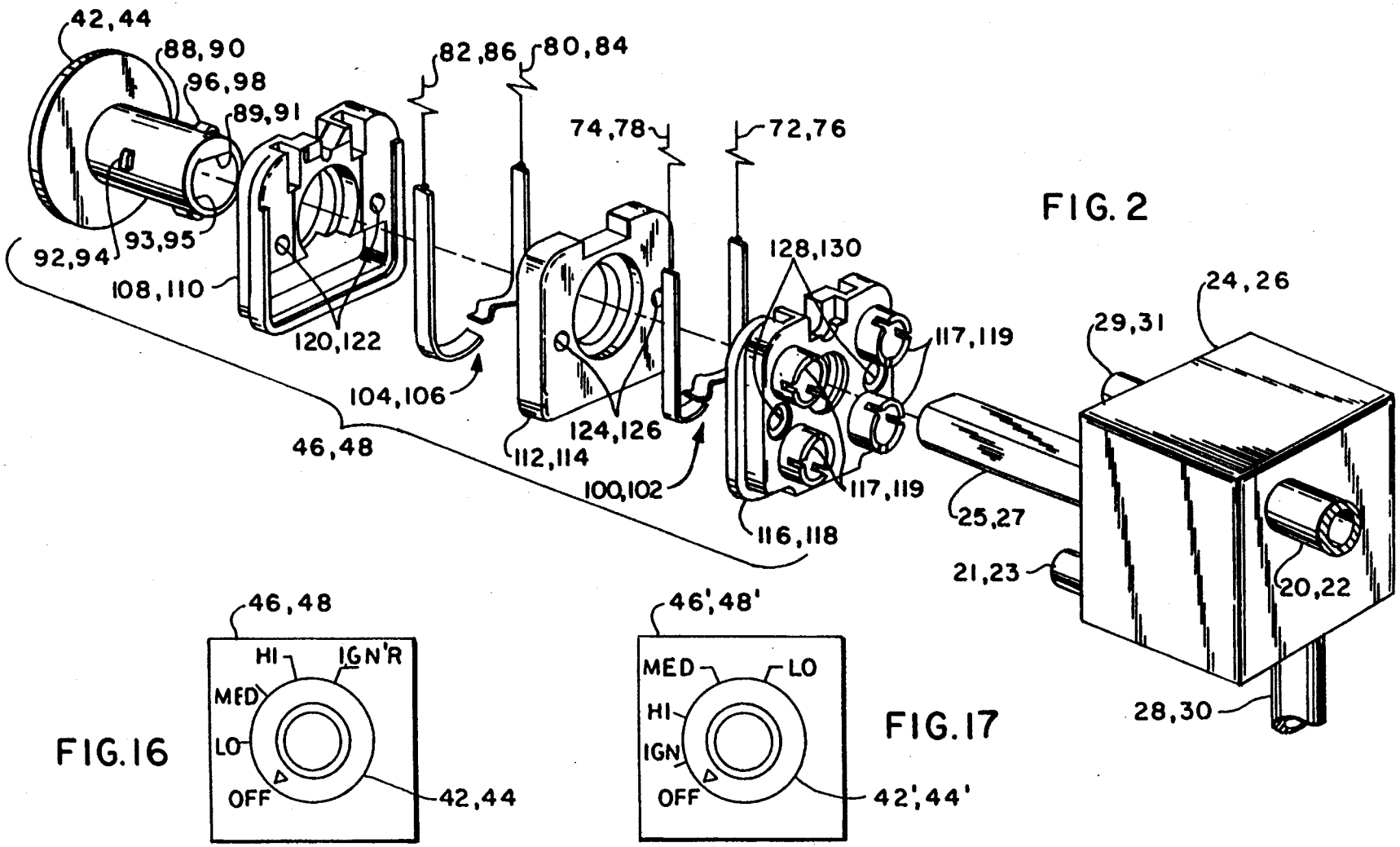
FIG. 2 is an exploded view typical of the burner control valve position detection switch and ignitor switch for the system of FIG. 1.
FIG. 16 is a view of a known burner control valve knob arrangement for use with the system of FIG. 1; and, FIG. 17 is a view of another known burner control valve arrangement for use with the system of FIG. 1.
Figure 3:
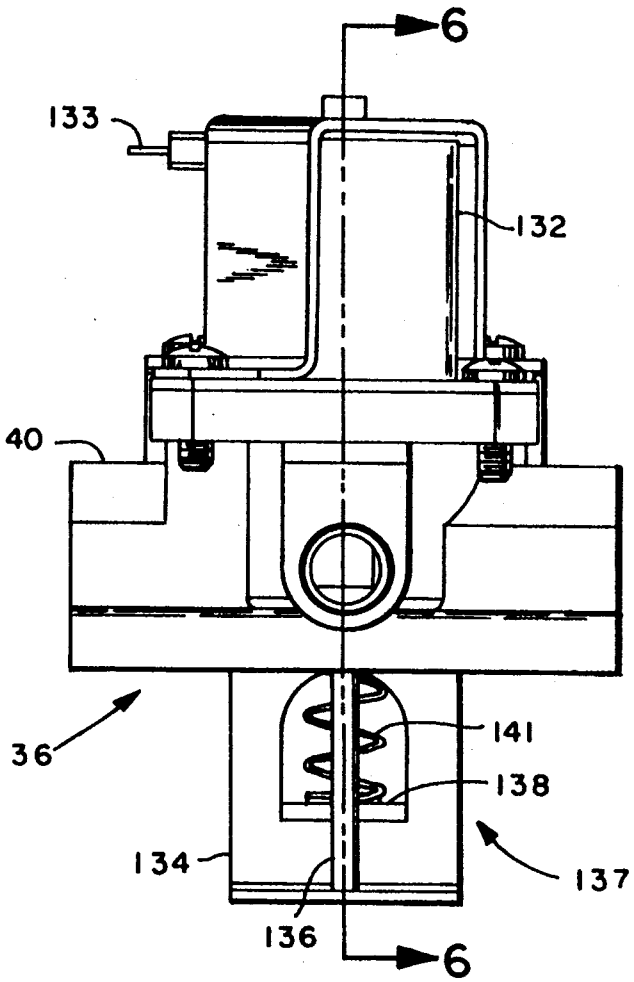
FIG. 3 is a side elevation view of the electrically operated line valve for the system of FIG. 1.
Figure 6:
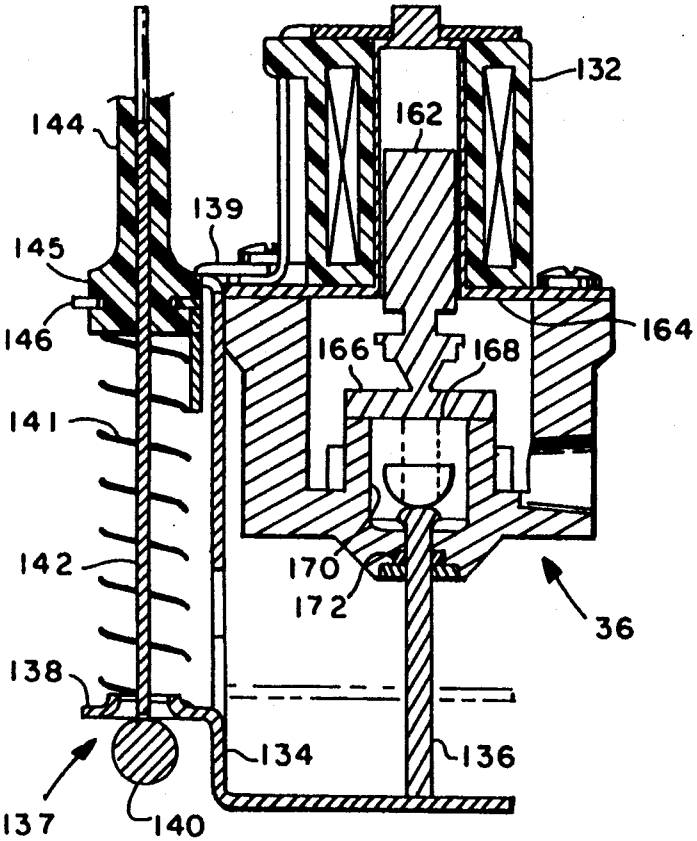
FIG. 6 is a section view taken along section indicating lines 6—6 of FIG. 3.
Figure 4:
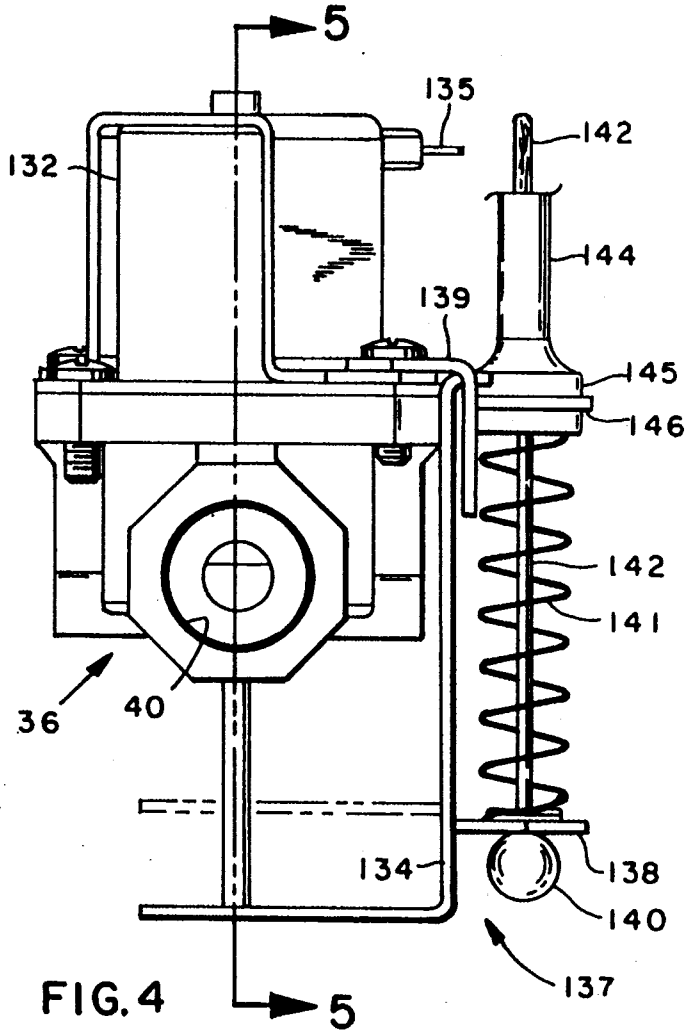
FIG. 4 is a right side elevation view of the valve of FIG. 3.
Figure 5:
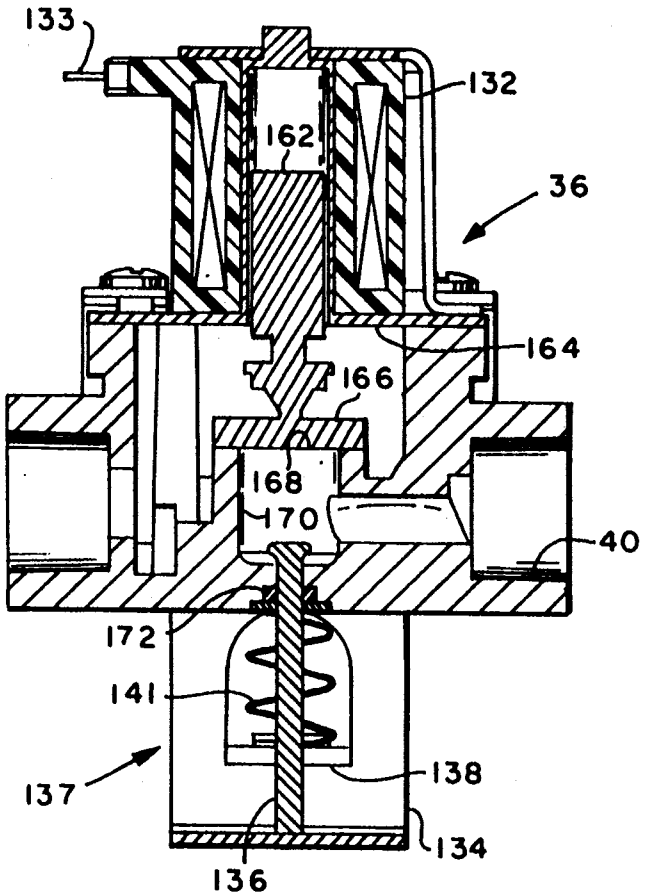
FIG. 5 is a section view taken along section indicating lines 5—5 of FIG. 4.
Figure 9:
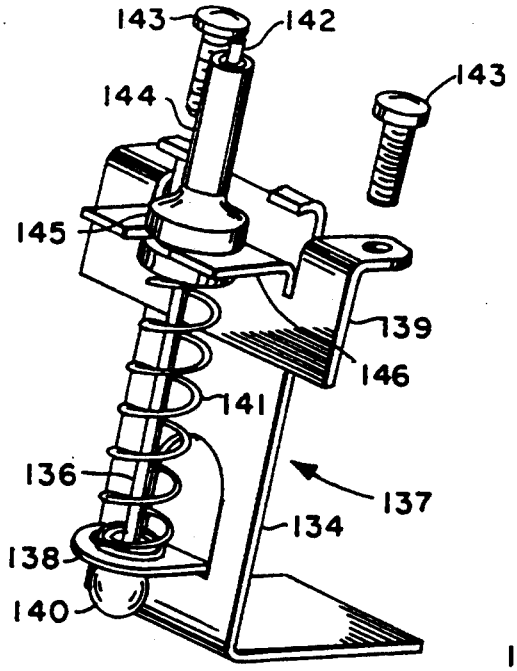
FIG. 9 is a perspective view of the manual override mechanism for the valve of FIG. 7.
Figure 7:
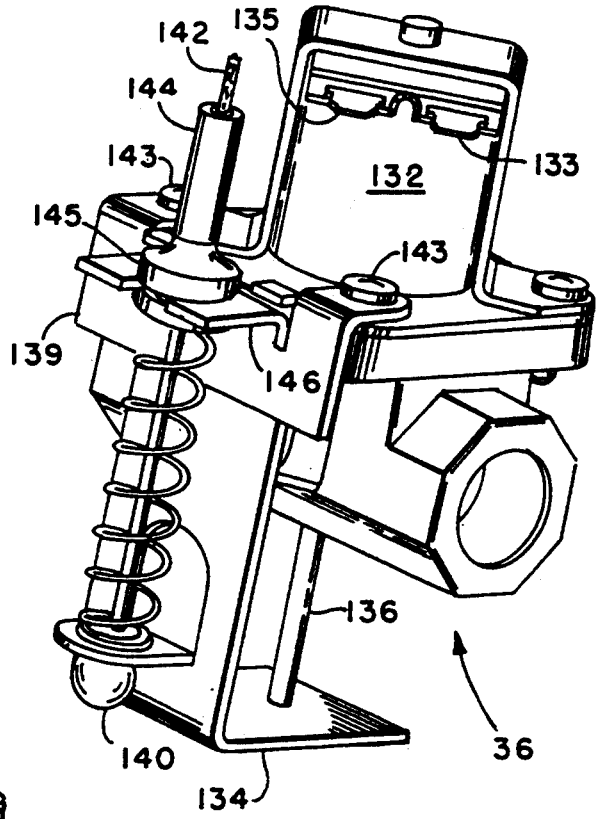
FIG. 7 is a perspective view of the line valve assembly of FIG. 1 including the manual override feature.
Figure 8:
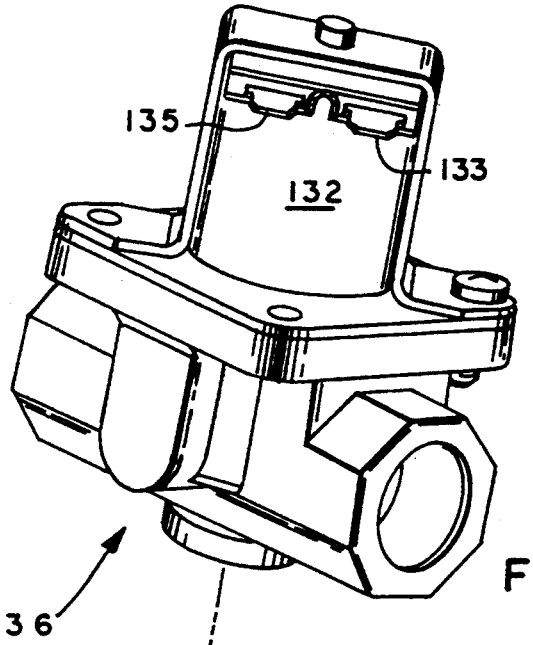
FIG. 8 is a view similar to FIG. 7 with the manual override mechanism removed.
Figure 10:
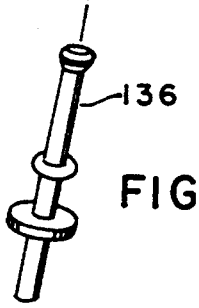
FIG. 10 is a view of the valve actuating rod of the valve of FIG. 7.

Referring to FIG. 2, one of the cam actuated switch assemblies 46, 48 is shown in exploded view it being understood that the internal construction of the assembly is identical for both of the assemblies 46, 48. Each of the switches 46, 48 has a cam drum denoted respectively 88, 90 which is received over the rotary valve member shaft denoted respectively 25, 27 for each of the burner valves 24, 26. It will be understood that valves 24, 26 may be of a type well known in the art and are operable for permitting the user to manually control the amount of gas flowing to the burner. The cam drums 88, 90 have each respectively thereon a first switch actuating cam 92, 94 and a second switch actuating cam 96, 98. Cams 92, 94 are each disposed for actuating one of the switches indicated generally at 104, 106; and 96, 98 are each disposed for actuating one of the switches denoted 100, 102. The cam drum 88, 90 for each of the assemblies 46, 48 has in internal flat denoted 89, 91 which is engaged by a corresponding flat formed on the shaft 25, 27 such that upon rotation of one of the knobs 42, 44 respectively the shaft 25, 27 effects movement of the drum 88, 90.

It will be understood that the cams 92, 94 and 96, 98 are located on the drum 88, 90 at a desired rotational position to cause the ignitor switches 100, 102 to close upon initial rotation of the valve shaft 25, 27 from the valve closed or "OFF" position. Upon subsequent rotation of either of the valve shafts 25, 27 to an "ON" position, the respective cam lobe 96, 98 effects closure of the valve position switch 104, 106 respectively to provide a signal to the electronic control unit 50 that the valve has been deliberately opened for operation of one of the burners 12, 14.

The switch assemblies 46, 48 each have the cam drum and switches 100, 102 and 104, 106 mounted and retained in a housing comprising three spacer blocks or sections denoted respectively for each of the switches by the reference numerals 108, 110 and 112, 114 and 116, 118. The spacer blocks are held together by suitable fasteners passing through the apertures provided in the spacers as denoted by reference numerals 120, 122 and 124, 126 and 128, 130; and, the fasteners have been omitted for clarity of illustration. Spacer block 116, 118 has a plurality of hollow locating bosses 117, 119 which engage respectively pins 21, 23 and 29, 31 on valve 24, 26 for orienting the switches with respect to the rotary position of shaft 25, 27.

It will be understood that the rotational position of the cam lobes 92, 94 and 96, 98 may be altered to provide the desired timing and sequence of the closing, including simultaneous closing, of the switches 100, 102 and 104, 106 with respect to the rotary position of the knobs 42, 44.

Referring to FIG. 16, one common known burner valve arrangement is shown wherein the control knob respectively 42, 44 is rotated first to the valve fully open position ("HI") and then to the Ignitor position for closing one of the ignitor switches 100, 102.

Referring to FIG. 17, an alternate arrangement also employed in present known ranges is shown wherein the knob 42, 44 for valve 46, 48 is first rotated to the ignitor position wherein switch 104, 106 closes and then the valve is rotated to the fully open ("HI") position.

Referring to FIGS. 1 and 3–13, the electrically operated line valve 36 is shown as having an electromagnetic operator in the form of solenoid 132 having a pair of connector terminals one of which, denoted by reference numeral 133, is connected to lead 58 which is connected to junction 61. The other terminal denoted by reference numeral 135 is connected via lead 59 to junction 56.

In the illustrated embodiment of FIGS. 3–10, valve 36 has provided thereon an optional manual override indicated generally at 137 comprising a sliding frame or bracket 134 having a plunger 136 attached thereto which is slidably secured to the valve body by bracket 139. Sliding bracket 134 operable to effect opening and closing of the valve, as will hereinafter be described, upon sliding movement of the bracket 134 between the position indicated in solid outline and the position indicated in dashed outline in FIGS. 4 and 6.

A cable mounting bracket or tab 138 is formed on bracket 134; and, tab 138 has received therethrough and anchored thereon an enlarged portion illustrated as the ball fitting 140 provided on the end of tension cable 142. The tension cable 142 extends through a cable jacket 144 having an enlarged end 145 anchored in a second tab 146 provided on bracket 139 secured to the body of valve 36 by screws 143. The jacket 144 and cable 142 extend upwardly as shown in FIG. 1 into a latching device indicated generally at 148 in FIGS. 1 and 11 and an extension cable 142' extends therefrom to a user actuation knob 150. It will be understood that when it is desired to manually open the electric valve 36, during a power outage, the user pulls on knob 150 drawing cable 142' which overcomes the force of the valve closing or return spring 141, which is provided between the tab 138 on the moveable bracket 134 and tab 146 on the bracket 139, and moves the bracket 134 and push rod 136 upward to the position shown in dashed outline which causes the push rod 136 to effect opening of the valve 36.

Referring to FIGS. 3–10, valve 36 has an armature 162 slidably mounted within the solenoid 132. The armature 162 is sealed about the valving chamber by a cover 164 which serves as the guide for the armature 162 which is connected to a poppet 166 which seats on a valve seating surface 168 which seals about an outlet passage 170. The operating rod 136 extends through a seal 172 provided in the bottom of the valve body and is operative upon upward movement to contact the undersurface of poppet 166 and open the poppet with respect to the valve seating surface 168 for manual override. During normal operation, the electromagnetic force of the solenoid 132 lifts armature 162 and poppet 166 from seating surface 168 for normal service cycling.

Figure 11:
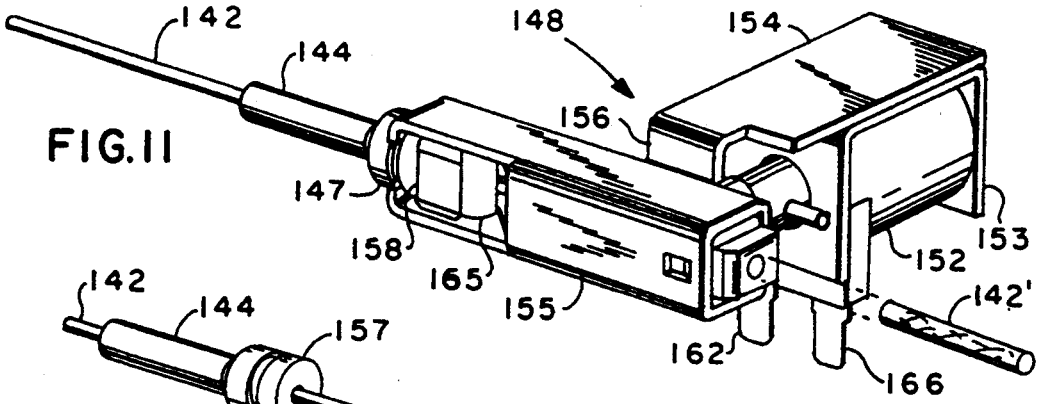
FIG. 11 is a perspective view of the electrically operated latching mechanism for the manual override of the valve of FIG. 7.
Figure 13:
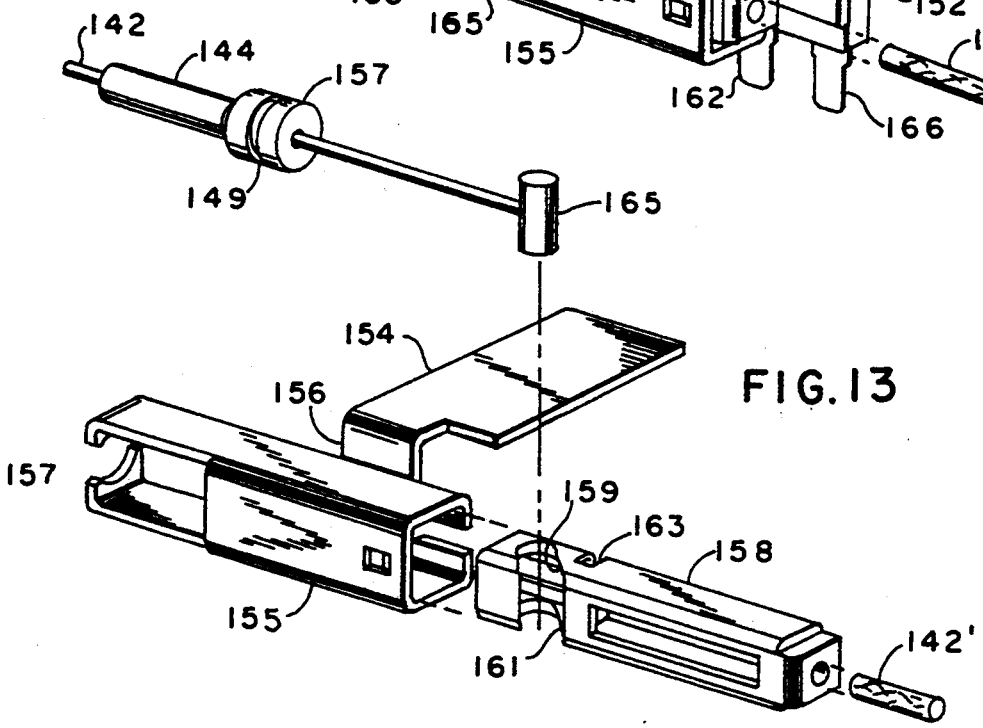
FIG. 13 is an exploded view of the latching mechanism of the assembly of FIG. 11.
Figure 12:
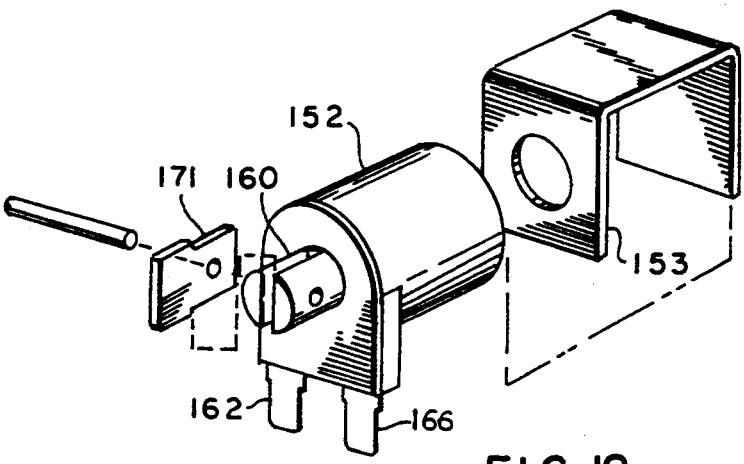
FIG. 12 is an exploded view of the electrical actuator for the mechanism of FIG. 11.

Referring to FIGS. 11–13, the latching mechanism indicated generally at 148 comprises an electromagnetic actuator which in the present practice comprises a solenoid 152 with pole frame 153 mounted on a mounting bracket 154 having a flange 156 which is formed to have a guide tube 155 formed thereon with a latching member 158 slidably received in the tube 155. The cable jacket 144 has a second enlarged end portion 147 with a groove 149 formed therein which engages a slotted aperture 157 formed in the end of tube 155. The cable 142 has an end fitting 165 in the form of a "T" bar which engages side slots 159, 161 formed in latching member 158.

The latching member 158 has a slot 163 provided therein which is engaged by the plate member 171 pinned to the solenoid armature 160 which is biased by an unknown spring in a direction to engage the slot 163 in the sliding latching member 158 when the cable 142 is pulled by the user. Upon energization of the solenoid through terminal 162, which is connected to the electronic control unit 50 via lead 164, and terminal 166 which is connected to junction 67 through lead 168, the armature of the solenoid is pulled in and latching member 158 is released and the sliding bracket 134 is returned to its valve closing position by spring 141.

Referring to FIG. 1, the fuel line 39 from the Tee is shown as connected to the inlet of an oven valve manifold or Tee 174 which has one outlet 176 connected to the inlet of an electrically operated burner valve 178 whose outlet is connected through conduit 180 to the inlet of an upper or BROIL burner 182 disposed in the oven 184 indicated by dashed outline in FIG. 1. The second outlet 186 of manifold or Tee 174 is connected to the inlet of a second electrically operated burner valve 188 which is disposed as the lower valve in oven 184. The outlet of valve 188 is connected through conduit 190 to the inlet of the lower or BAKE burner 192.

An electrical resistance type ignitor 194 is disposed adjacent burner 182; and, similarly an electrical resistance type ignitor 196 is disposed adjacent burner 192.

The electrically operated valves 178, 188 are typically of the type employing a bi-metal valve operator heated by a coil of resistance wire adjacent the bi-metal operator with the resistance wire connected electrically in series with the burner ignitor.

Thus, ignitor 194 has one terminal thereof denoted 198 connected via lead 200 to one terminal 202 of valve 178. The opposite terminal 204 of ignitor 194 is connected via lead 206 to terminal 207 of a selector switch 230. The remaining terminal 210 of valve 178 is connected via lead 212 to junction 63 which is connected also through lead 216 to one terminal 218 of valve 188.

The remaining terminal 220 of valve 188 is connected via lead 222 to one terminal 224 of ignitor 196, with the remaining terminal 226 thereof connected via lead 228 to junction 208.

Junction 208 is connected to both side positions of switch 230 which has its common terminal 232 connected via lead 234 to one side of oven thermostatic switch 236 in thermostat 238, with the opposite side of switch 236 connected via lead 240 to junction 56.

The thermostat 238 typically is of the type which includes a fluid pressure sensing diaphragm (not shown) which responds to pressure in a capillary tube 244 connected to a temperature sensing bulb 246 located in the oven 184. Increases in temperature in the oven create fluid pressure in the capillary 244 which moves the diaphragm 242 which is connected as shown in dashed outline in FIG. 14 to the moveable arm of switch 236 which is biased to the normally closed position by a spring (not shown), the preload of which is varied by a rotary cam (not shown) positioned by user rotation of knob 248 with which the user selects the temperature desired in the oven. Upon the oven reaching the desired temperature, liquid in bulb 246 expands through capillary 244, causing the diaphragm to open the switch 236 permitting the oven to cool until the liquid in bulb 246 contracts to re-close switch 236 and again provide a signal to the electronic control unit to relight the burner. The choice of the oven burner desired for operation is made by the user rotating knob 250 which is connected as shown by dashed outline in FIG. 1 to effect movement of the selector switch 230.

Thermostat 238 contains a second switch 252 which is normally open and has one side connected to junction 83 and the opposite side connected via lead 254 to the ECU. Switch 252 is closed upon the bulb 246 sensing a preselected oven temperature.

Switch 236 is operated or closed by user rotation of knob 248 from an open or "OFF" position to a closed position; and, upon closure of switch 236, further rotation of knob 248 is operative to select the desired temperature by changing the length of the internal bias spring (not shown).

Figure 15A:
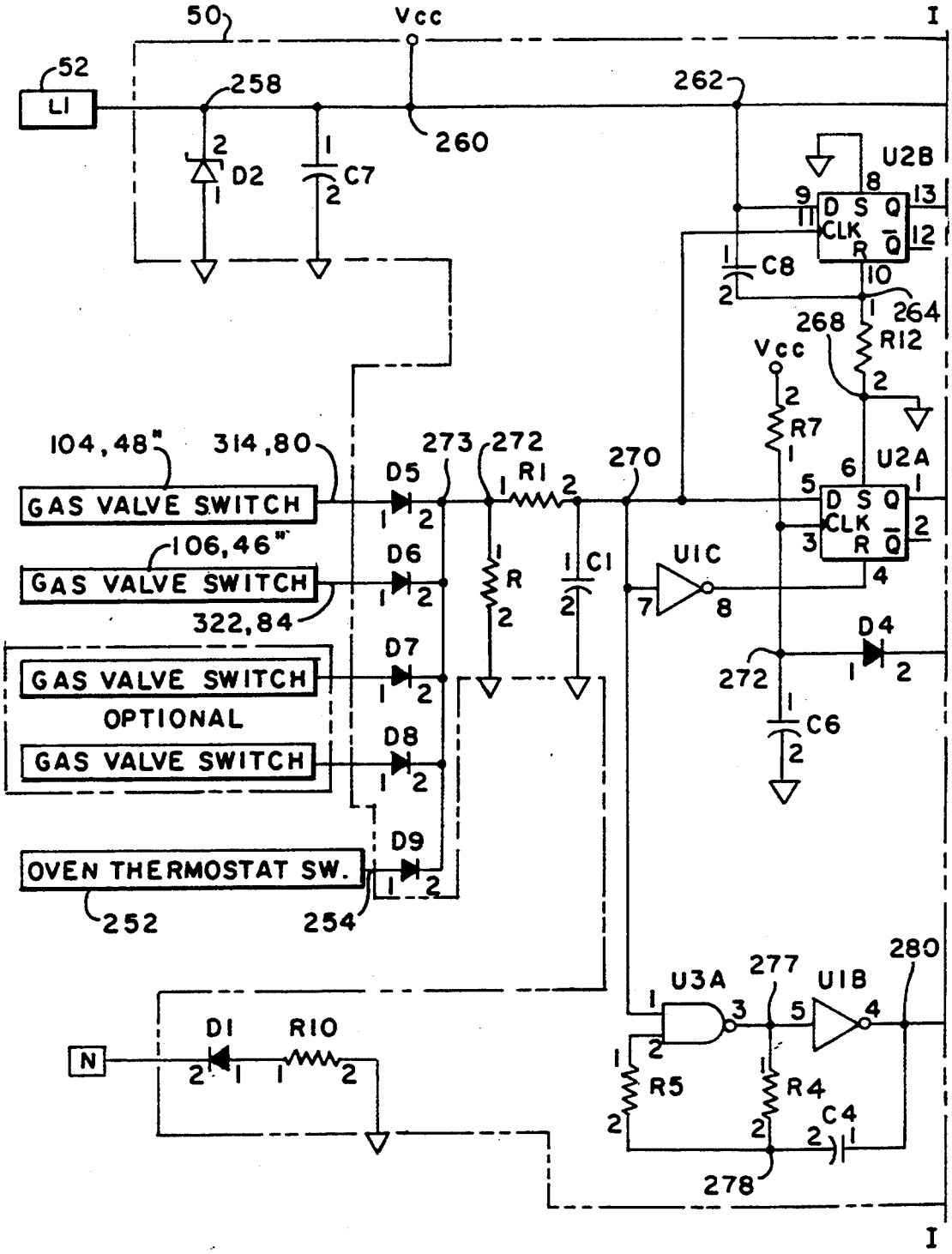
FIG. 15*a* is a portion of an electrical schematic for the system of FIG. 1 divided along parting line I—I.
Figure 15B:
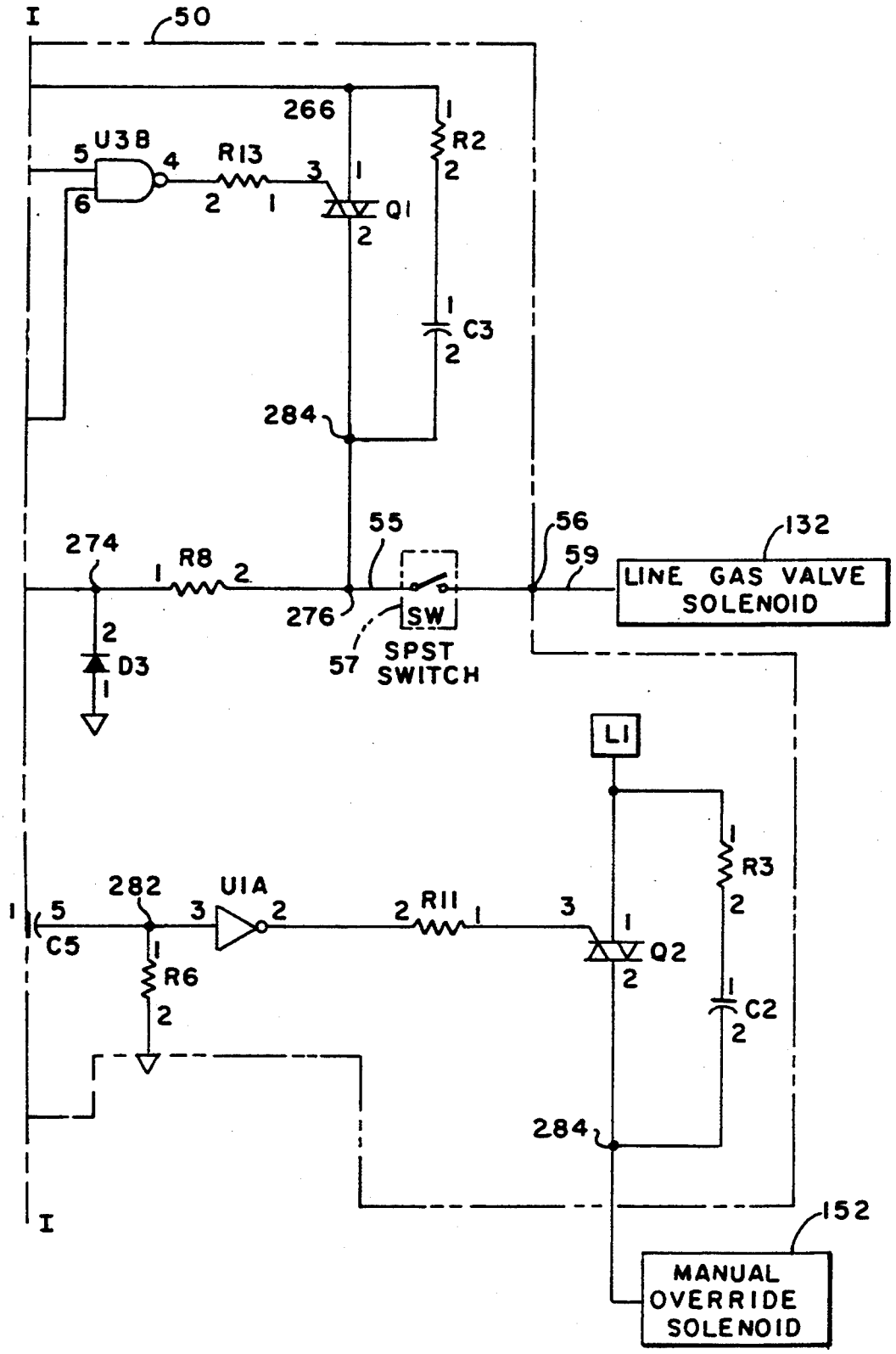
FIG. 15*b* is the remainder of the electrical schematic of FIG. 15*a;*

Referring to FIGS. 15*a* and 15*b*, the circuitry for the system of FIG. 1, wherein the electronic control unit 50 is shown with the top burner valve position switches 104, 106 and the thermostat position switch 252 for the oven burners providing inputs respectively through leads 80, 84, 254 to diodes D5, D6 and D9 to the ECU 50. It will be understood that on a range having four top burners, the additional two valve position switches labeled "OPTIONAL" in FIG. 15*a*, would provide inputs through diodes D7, D8.

Power line lead 52 is connected to a junction 258 which is connected to ground through a reverse poled Zener device D2 and also through capacitor C7. Junction 260 is connected to the supply voltage for $V_{cc}$ and also to junction 258. The voltage $V_{cc}$ is supplied also to junction 262 which is connected to pin 9 of a D flip-flop U2B. Flip-flop U2B has pin 8 grounded and the reset pin 10 connected to a junction 264 which is connected through capacitor C8 to junction 262.

Referring to FIG. 15*b*, junction 262 is also connected to junction 266 which is connected to one side of a Triac Q1.

Referring to FIGS. 15*a* and 15*b* the output Q at pin 13 of U2B is connected to one input of a NAND device U3B whose output is connected through resistor R13 to the gate of Triac Q1.

Junction 264 is also connected through a resistor R12 to junction 268 which is grounded and also connected to the SET input, pin 6, of D flip-flop U2A. U2A has its input pin 5 connected to junction 270 which is also connected to the CLOCK pin 11 of U2A and also through C1 to ground. Junction 270 is also connected through resister R1 to junction 272 which is connected through R9 to ground and also connected to one of the burner valve switch input diodes through junction 273 which is connected to junction 272. The RESET terminal pin 4 of U2A is connected to the output of inverter U1C which has its input connected to junction 270. Junction 270 is also connected to one input of NAND U3A. The CLOCK input pin 3 of device U2A is biased by $V_{cc}$ through R7 and is also connected to junction 272 which is connected through C6 to ground and also connected to forward poled diode D4 whose opposite pole is connected to junction 274. Junction 274 is also connected through reverse pole diode D3 to ground. Junction 274 is also connected through R8 to junction 276 which is connected to the output of Triac Q1.

Junction 266 is also series connected through R2 and C3 to junction 276 which is also connected through lead 55 to the one terminal of the line valve switch 57.

Junction 270 is also connected to the input of inverter amplifier U1C whose output is connected to RESET pin 4 of U2A. Junction 270 is also connected through one input of NAND U3A whose output is connected to junction 277 which is connected to the input of inverter amplifier U1B and also through R4 to junction 278. Junction 278 is connected through R5 to the remaining input of U3A and also connected through C4 to junction 280 which is connected to the output of U1B. Junction 280 is also connected through C5 to junction 282 which is connected through R6 to ground and also connected to the input of inverter amplifier U1A whose output is connected through R11 to the gate of Triac Q2.

One side L1 of the power line is also connected to the input of Triac Q2 and also through R3 and C2 to junction 284. The output of Triac Q2 is connected through junction 284 and lead 164 to the latching solenoid 152.

The opposite side of the power line 54 is connected through reverse poled diode D1 and R10 to ground. The values and designations for the various circuit components are listed in Table I below.

TABLE I

| R | Ohms | C | μ Farads | DEVICE | TYPE |
|---|---|---|---|---|---|
| 1 | 22K | 1 | 0.1 | Q1 | TRIAC |
| 2 | 100, ½ W | 2 | 0.1, 250 V | Q2 | TRIAC |
| 3 | 100, ½ W | 3 | 0.1, 250 V | U1A | 4009 |
| 4 | 330K | 4 | 22 | U1B | 4009 |
| 5 | 4.3 Meg | 5 | 0.1 | U1C | 4009 |
| 6 | 560K | 6 | 0.1 | U2A | 4013 |
| 7 | 7.5K | 7 | 1500, 25 V | U2B | 4013 |
| 8 | 39K, ½ W | 8 | 0.1 | U3A | 4011 |
| 9 | 7.5K | 9 | | U3B | 4011 |
| 10 | 1.2K, 5 W | | | D1 | 1N4004 |
| 11 | 430, ½ W | | | D2 | 1N5245, 15 V |
| 12 | 100K | | | D3 | 1N4004 |
| 13 | 430, ½ W | | | D4 | 1N4004 |

In operation, D1, D2, C7 and R10 function as a filter network to provide a regulated power supply $V_{cc}$ for the circuit.

Upon power-up by user closure of either of the switches 104, 106 for the top burners, or selector switch 230 and thermostat switch 252 for the oven burners, C8 and R12 reset the D flip-flop U2B forcing the Q output of U2B to a logic zero or "low". When the Q output of U2B is "low" on the input of NAND gate U3B, the output of U3B goes to a logic one or "high". When the output of U3B goes "high", this signal applied to the gate of Triac Q1 maintains the Triac Q1 in a non-conductive state and prevents power from being applied to the line valve switch 57. When the output of U3B goes to a logic zero or "low", this triggers the Triac Q1 to conduct and apply power to the line valve switch 57; and if the user closes switch 57, power is applied to the solenoid 132 opening line valve 36. To enable D flip-flop U2B (i.e., bring the Q output to a logic "high") requires that either of the burner valve switches 104, 106 be first opened and then closed to provide a rising edge to the CLOCK input of D flip-flop U2B.

The network comprising R7, R8, D3, D4 and C6 determines the state of the switch 57. With the Triac Q1 in the non-conductive state and the switch 57 in the open state, the voltage at the CLOCK input of U2A is at a steady voltage level of $V_{cc}$ dropped by R7 and filtered by C6. With the switch 57 in the closed state a half wave rectified current goes through R7, R8, D4, switch 57 and the solenoid 132. D3 acts as a ground clamp so that the voltage at the CLOCK input does not go below the level of circuit ground. This arrangement gives a 60 hertz, 50% duty cycle square wave signal at the CLOCK input of U2A. The rising edge of this signal will clock in the state of any of the burner valve switches 104, 106 and 100, 102 and 252 to the Q output of U2A and the input to NAND gate U3B. If any of the aforementioned burner valve switches are in the closed state, then a logic "high" is applied to the input of U3B; and, with the Q output of U2B at a logic "high", Triac Q1 is in the conductive state. With Triac Q1 conducting, there will not be a 60 hertz square wave at U2A CLOCK input. When none of the gas burner valve switches 104, 106 and 252 is in the closed state, the output of inverter U1C will go "high" resetting the Q output of U2A to a logic "low". This in turn disables the Triac Q1 through the U3B NAND gate cutting off power to the line valve switch 57.

With any of the gas burner valve switches, 104, 106 and 252 in the closed state, the circuit network comprising U3A, U1B, U1A, R4, R5, R6, C4 and C5 provides a 50 millisecond pulse output at ten second intervals. Circuit network comprising U3A, U1B, R4, R5 and C4 performs as a gated astable oscillator with a time period of ten seconds. The output of U1B goes through the differentiating circuit comprising C5 and R6 to provide a 50 millisecond pulse to the inverter input of U1A whose output drives the gate of Triac Q2. Thus, each time one of the burner valve switches is closed after the burner valve has been in the "OFF" or closed state, the solenoid 152 is energized to release latching mechanism 148.

Figure 14:
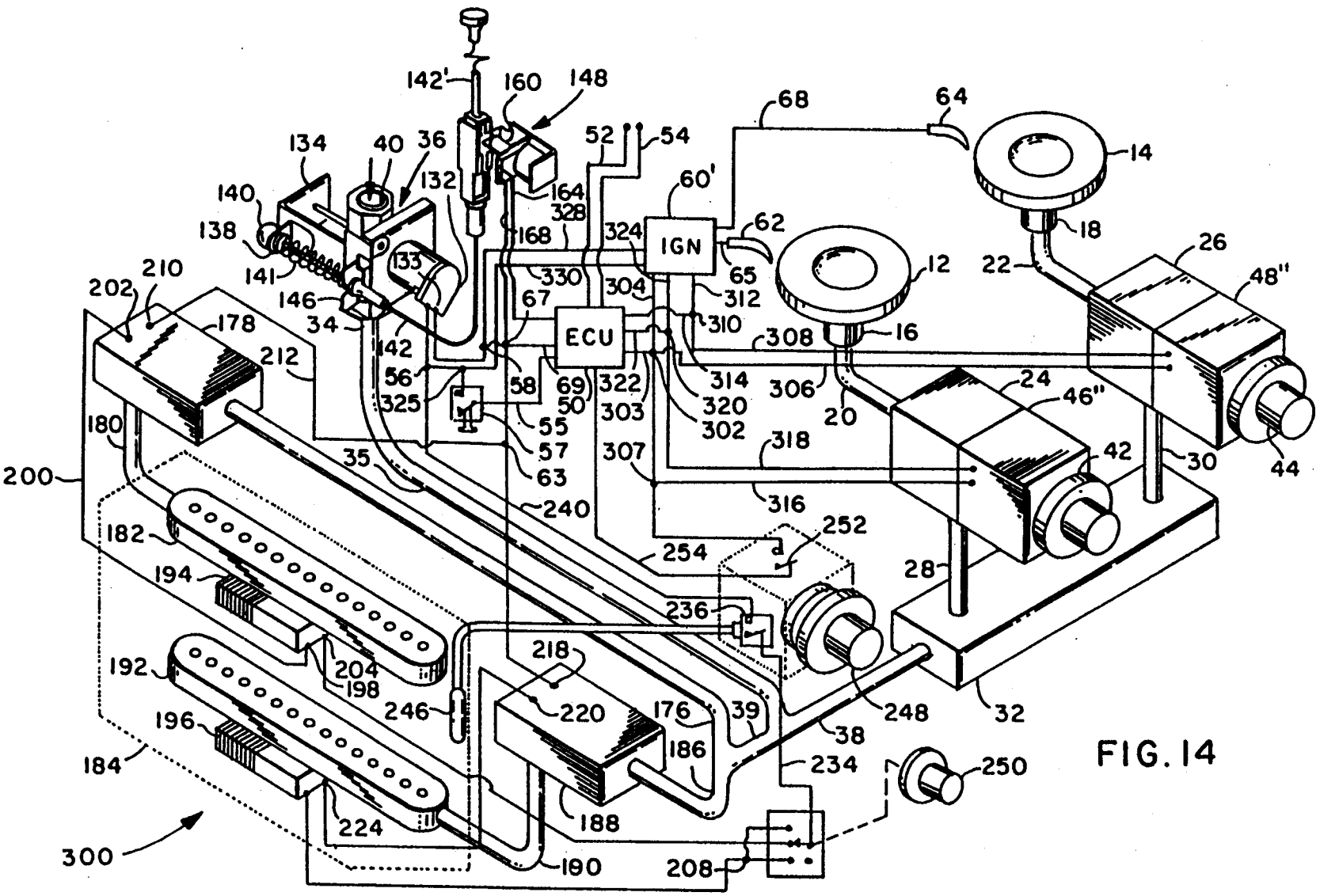
FIG. 14 is a alternate embodiment of the system of FIG. 1 employing a flame sensor.

Referring to FIG. 14, another embodiment of the invention is indicated generally at 300 for a cooking range having a pair of top burners and a pair of oven burners arranged in a manner similar to that of the embodiment of FIG. 1. It will be understood that components which are identical to the components used in the FIG. 1 embodiment are denoted by the same reference numeral in FIG. 14. The embodiment of FIG. 14 is similar to the embodiment of FIG. 1 except that in the FIG. 14 embodiment, the top burner valves 24, 26 are operated by cam actuated switch assemblies respectively 45'', 48'' which have only a single cam operated switch therein for connection to the ignitor circuitry and the ECU 50 as will hereinafter be described.

The embodiment 300 of FIG. 14 employs an ignitor circuit 60' which receives line power at junction 302 from the ECU along leads 303 and 304; and, junction 302 is also connected to junction 307 and to lead 306 which is connected to one side of the switch employed in the switch assembly 48''. It will be understood that the internal construction of the switch assembly 48'' is a single switch corresponding to the construction of the switches illustrated in FIG. 2. The other side of the switch in assembly 48'' is connected via lead 308 to junction 310 which is connected via lead 312 to the ignitor circuitry and through lead 314 to one of the EUC inputs such as diode D5 in FIG. 15*a*.

Junction 307 is also connected via lead 316 to provide power to one side of a switch located within the burner valve switch assembly 46'' which may be of construction identical to one of the switches illustrated in FIG. 2. The other side of the burner valve switch located within assembly 46'' is connected via lead 318 to junction 320 which is connected via lead 322 to one of the inputs such as diode D6 of the ECU 50. Junction 320 is also connected via lead 324 to the ignitor circuit.

The ignitor circuitry 60' is connected along lead 328 via junction 58 to terminal 133 of the line valve solenoid 132. Junction 56 is connected to one side of line valve switch 57 via junction 325 and also along lead 330 to the ignitor circuitry.

It will be understood that the ignitor circuitry 60' is of the type which responds to the presence of flame on either of the spark electrodes 64, 62 to provide a signal to discontinue the sparking. Such techniques are well-known in the art as for example by flame rectification or change in resistance due to the presence of flame.

In operation, the user closes switch 57 and rotates one of the burner valve control knobs 248, 42, 44 to effect closing of one of the switches 252, 46'', 48'', thereby providing a signal to the ECU along one of the leads 254, 322, 314 and to the ignitor circuitry 60' along leads 324, 312. The ignitor circuitry is operative to begin sparking on one of the electrodes 64, 62 and to complete a circuit to permit current to flow along lead 328 to solenoid terminal 133, through the solenoid 132 and through switch 57; and, only upon the ECU sensing the appropriate sequence of events as described hereinabove with respect to the embodiment of FIG. 1, e.g., that the switch 57 has been closed before one of the burner valve switches, current is allowed to flow to the Neutral to complete a circuit.

In the event of the loss of flame at one of the burners 12, 14, the ignitor circuitry 60' is operative to begin sparking again automatically in a manner well known in the art.

The present invention thus provides a unique control system for gaseous fuel burners wherein the user must first close a line switch series connected with an electrical line valve operator and then open one of the burner valves such that the switch senses the valve position and signals an electronic control unit which then completes the circuit to the line valve operator to effect opening of the line valve and fuel flow to the burner. The control system of the present invention may include a manually actuated override for enabling the line valve to opened during periods of power outage. The control system of the present invention may be employed for a range having a plurality of top burners and oven burners and may be employed either with or without flame sensing techniques for the ignitors utilized with the top burners.

Although the invention has hereinabove been described with respect to the illustrated embodiments, it will be understood that the invention is capable of modification and variation and is limited only by the following claims.

I claim:

1. A control system for a gaseous fuel burner comprising:

(a) an electrically operated line valve having an inlet adapted for connection to a fuel gas line and an outlet and operable upon energization to effect flow from said inlet to said outlet;

(b) a user operated burner valve having the outlet thereof connected to supply the burner and the inlet thereof connected to receive fuel gas from the outlet of the line valve, said burner valve having a control member operable upon movement from a first position to a second position to permit fuel gas flow from the inlet to the outlet of said burner valve;

(c) a signal switch connectable to a power line and operable to close a first set of electrical contacts in response to movement of said control member to said second position;

(d) an ignition switch connectable to a power line and operable to close a second set of electrical contacts upon movement of said control member to said second position;

(e) ignitor means, series connected to said second set of contacts and operable upon closure thereof to ignite a fuel gas mixture emanating from said burner;

(f) circuit means connected to said signal switch and said ignition switch and operable upon connection to a power line to energize said line valve in response to sequential closing of said ignition switch followed by closing of said first set of contacts.

2. The system defined in claim 1 wherein upon a line power outage during burner operation, said circuit means is operative to require user movement of said burner valve control member to said first position and return to said second position before said line valve is re-energized upon resumption of line power.

3. The control system defined in claim 1, wherein said electrically operated line valve includes a manual override member operable upon user movement to effect opening of said line valve during line power outage.

4. The control system defined in claim 1, wherein a said electrically operated line valve includes a manual override member operable upon user movement to effect manual opening of said line valve; and, releasable latching means operable to latch said line valve manual override member in the valve open position, wherein said circuit means is operable upon connection to electrical power To release said latching means; and, means biasing said line valve to close.

5. The control system defined in claim 1, wherein said line valve includes a manual override member operably connected upon user movement effecting manual opening of said line valve and electrically releasable latching means operable to latch said override member in the valve open position; and, means biasing said override member to the valve closed position.

6. A method of controlling operation of a fuel gas burner comprising:

(a) providing a line valve operable upon electrical energization and connecting the inlet to said source and the outlet to the inlet of a user operated control valve having an open and closed position and connecting the outlet of the control valve to the burner;

(b) connecting a first and second set of contacts to an electrical power line and closing said contacts in response to opening said control valve;

(c) series connecting said first set of contacts to an electrically operated ignitor for said burner;

(d) closing a detector switch and opening said control valve;

(e) energizing said line valve only when control valve is opened sequentially after said closing of said detector switch; and, (f) requiring user closing and reopening of the control valve for restoring said line valve to the open condition in the event of an electrical power outage.

7. The method defined in claim 6, wherein said step of requiring includes electronically sensing the sequence and state of operation of said detector switch and said control valve.

8. The method defined in claim 6, wherein said closing of said contacts includes camming said contacts in response to said control valve open position.

9. The method defined in claim 6, wherein said step of energizing said line valve includes electronically sensing the state of said second set of contacts and said detector switch.

10. The method defined in claim 6, further comprising providing an override and manually opening said line valve during an electrical power outage and latching said valve open; and, electrically unlatching said valve upon restoration of power after said outage.

11. A control system for gaseous fuel burner comprising:

(a) an electrically operated line valve having an inlet adapted for connection to a fuel gas line and an outlet and operable upon energization to effect flow from said inlet to said outlet;

(b) a user operated burner valve having an inlet and outlet and a control member operable upon user movement between a first position to a second position to effect opening and closing of the valve;

(c) conduit means connecting said burner valve inlet to the outlet of said line valve and said burner valve outlet to the burner;

(d) detector means operable to detect said control member position and provide an electrical signal indicating the burner valve is open;

(e) ignitor means operable upon electrical energization to effect igniting of fuel mixture emanating from said burner;

(f) ignition switch means operable, upon connection to a power line, to provide an ignitor signal when said control member is in said second position;

(g) circuit means operable, upon sequential receipt of said ignitor signal followed by said burner valve open signal, for energizing said line valve.

12. The control system defined in claim 11, wherein said line valve includes manual override means operable, upon user actuation during electrical power outage to effect opening of said line valve.

13. The control system defined in claim 11, wherein said line valve includes:

(a) manual override means operable upon user actuation to effect opening thereof during power outage;

(b) latching means operable to maintain said override means in the valve open condition until power is restored; and, (c) said circuit means is operable, upon restoring power after an outage, to release said latching means and said override means returns said line valve to the closed condition.

14. The control system defined in claim 11, wherein said line valve includes manual override means operable upon user actuation to effect opening of said line valve during a power outage, said override means including spring means biasing said valve closed and a lost-motion actuator; and electrically releasable latching means operable to latch said override means in the valve open position and operable upon receipt of a signal from said circuit means to release said override means.

15. The control system defined in claim 11, wherein said circuit means includes reset means operable, upon a power outage during said line valve energization, to require, when power is subsequently restored, closing and re-opening of said burner valve before said line valve is re-energized.

16. The control system defined in claim 11, wherein said line valve includes manual override means operable upon user actuation during power outage to releasably latch said line valve open; and, said circuit means includes reset means operable to release said latch each time said line valve is energized.

17. A method of controlling operation of a fuel gas burner comprising:

(a) providing an electrically energizeable ignitor proximate said burner;

(b) providing an electrically operated line valve and closing a line switch for energizing said valve;

(c) opening a selector valve connected to said line valve for supplying fuel gas to the burner and energizing said ignitor for igniting the fuel gas;

(d) detecting the opening of said selector valve and supplying electrical power to said line valve only if said opening of said selector valve occurs within a predetermined time after said closing of said line switch.

18. The method defined in claim 17, wherein said detecting includes closing a detector switch.

19. The method defined in claim 17, wherein the step of opening a selector valve includes manually moving a valve actuating member.

20. The method defined in claim 17, wherein said step of supplying fuel gas to said selector valve includes energizing an electrically operated line valve and requiring user closing and reopening of said selector valve upon restoring electric power after an outage.

21. A control system for controlling operation of a gaseous fuel burner comprising:

(a) selector valve means connected for, upon user opening, providing for a flow of fuel gas to the burner;

(b) an electrically operated line valve for connection to a fuel gas source and connected for, upon energization, supplying fuel gas to said selector valve means;

(c) ignitor means electrically energizeable and disposed for igniting gas at said burner;

(d) ignition switch means operable upon connection to a power line, and in response to user opening of said selector valve means to energize said ignitor means;

(e) detector means operable to provide an electrical indication that said selector valve is open;

(f) circuit means operable upon sequentially first receiving said arming signal followed by said electrical indication that said selector valve is open to energize said line valve.

22. The system defined in claim 21, wherein said detector means includes a switch actuated by said user opening said selector valve means.

23. The system defined in claim 21, wherein said circuit means is operable, upon power line outage when said line valve is energized to require user closing and reopening of said selector valve means upon power restoration before re-energization of said line valve.

24. The system defined in claim 21, wherein said line valve includes a manual override means operable upon user movement thereof during a power outage to effect opening of said valve.

25. The system defined in claim 21, wherein said line valve includes a manual override means operable upon user movement thereof during a power outage to effect opening of said line valve; and, releasable means latching said override means in the valve open position.

26. The system defined in claim 21, wherein said line valve includes a manual override means operable upon user movement thereof during a power outage to effect opening of said line valve; and, electrically releasable means latching said override means in the valve open position; and, said circuit means is operable to release said latching means upon energization of said line valve.

27. The system defined in claim 21, further comprising a disablement switch series connected with said line valve and operable upon user de-actuation to prevent energization of said line valve.

28. A method of controlling operation of gaseous fuel burner comprising:

(a) connecting the inlet of an electrically operated line valve to a source of gaseous fuel;

(b) connecting the outlet of said line valve to supply the inlet of a user moveable burner control valve and connecting the burner valve outlet to supply the burner;

(c) providing an ignitor proximate the burner;

(d) detecting user movement of said control valve and energizing said ignitor in response thereto;

(e) detecting said ignitor energization and electrically opening said line valve in response thereto; and, (f) preventing, upon a power outage and restoration, re-opening of said line valve unless said control valve has been closed and re-opened.

29. The method defined in claim 28 further comprising opening a remote switch and disabling said line valve.

30. A method of controlling a gaseous fuel burner comprising:

(a) providing an electrically operated line valve with a line switch and electrically energizeable ignitor proximate said burner;

(b) closing the line switch;

(c) opening a selector valve connected to said line valve for supplying fuel gas to the burner and energizing said ignitor;

(d) detecting the energizing of said ignitor and supplying power to said line switch; and, (e) providing a flame sensor and cutting off power to said line switch if the flame is not sensed within a predetermined time interval after said supplying power to said line switch occurs.

* * * * *